US009470100B2

(12) United States Patent
Berquier et al.

(10) Patent No.: US 9,470,100 B2
(45) Date of Patent: Oct. 18, 2016

(54) TURBINE ROTOR FOR A THERMAL ELECTRIC POWER STATION

(71) Applicant: ALSTOM Technology Ltd, Baden (CH)

(72) Inventors: Christophe Berquier, Neuilly Plaisance (FR); Andre Batot, Hericourt (FR)

(73) Assignee: General Electric Technology GmbH, Baden (CH)

( * ) Notice: Subject to any disclaimer, the term of this patent is extended or adjusted under 35 U.S.C. 154(b) by 680 days.

(21) Appl. No.: 13/847,163

(22) Filed: Mar. 19, 2013

(65) Prior Publication Data

US 2014/0127027 A1 May 8, 2014

(30) Foreign Application Priority Data

Mar. 19, 2012 (FR) ..... 12 52457

(51) Int. Cl.
*F01D 5/30* (2006.01)
*F01D 5/32* (2006.01)

(52) U.S. Cl.
CPC ..... *F01D 5/326* (2013.01); *F01D 5/30* (2013.01); *Y10T 29/49321* (2015.01)

(58) Field of Classification Search
CPC .... F01D 5/30; F01D 5/326; Y02T 27/49321
USPC ..... 416/97 R, 220 R
See application file for complete search history.

(56) References Cited

U.S. PATENT DOCUMENTS 3,158,353 A * 11/1964 Salt ..... F01D 5/323 29/889.21
4,349,318 A 9/1982 Libertini et al.
(Continued)

FOREIGN PATENT DOCUMENTS

CN 101333942 A 12/2008
CN 102245859 A 11/2011
(Continued)

OTHER PUBLICATIONS

English Translation of Cited Art FR2017206 from FR Search Report dated Nov. 22, 2012.
(Continued)

*Primary Examiner* — Audrey K Bradley
*Assistant Examiner* — Dapinder Singh
(74) *Attorney, Agent, or Firm* — GE Global Patent Operation

(57) ABSTRACT

The technical field of the invention is that of turbine rotors for a thermal electric power station and the subject of the invention is, more particularly, a rotor of a turbine for a thermal electric power station, said rotor comprising a plurality of blades, each comprising at least one root and a vane; and at least one rotor disk secured to a shaft able to be in rotation about a reference axis, the rotor disk comprising on its periphery outgrowths in which to fit the blades, so that the vanes of the blades are arranged radially with respect to the reference axis; said rotor being one wherein: the rotor disk comprises a groove opening axially and having a lower face and an upper face, the lower face of the groove of the rotor disk being situated on the periphery of said rotor disk and the upper face of the groove of the rotor disk being situated on the outgrowths and facing the lower face; each of the blades comprises, at its root, a lateral projection directed axially, said lateral projection having, in its lower part, a groove portion having an upper face situated in the continuation of the upper face of the groove of the rotor disk; at least one locking means for locking the blades is positioned in the groove of the rotor disk.

13 Claims, 6 Drawing Sheets

(56) References Cited

U.S. PATENT DOCUMENTS

| | | | | |
|---|---|---|---|---|
| 4,389,161 | A * | 6/1983 | Brumen | F01D 5/326 416/198 A |
| 5,256,035 | A | 10/1993 | Norris et al. | |
| 5,662,458 | A | 9/1997 | Owen | |
| 7,442,007 | B2 * | 10/2008 | Bibor | F01D 5/3007 416/193 A |

FOREIGN PATENT DOCUMENTS

| | | | |
|---|---|---|---|
| FR | 2017206 | A1 | 5/1970 |
| FR | 2824870 | | 11/2002 |
| GB | 2089899 | A | 6/1982 |
| RU | 2296864 | C1 | 4/2007 |

OTHER PUBLICATIONS

FR Search Report Nov. 22, 2012.

Ishlinsky "New Polytechnical Dictionary", "Great Russain Encyclopedia", pp. 531, 2000.

Unofficial English Translation of Russian Office Action issued in connection with corresponding RU Application No. 2013111505 on Oct. 7, 2014.

Unofficial English Translation of Russian Notice of Allowance issued in connection with corresponding RU Application No. 2013111505 on Dec. 1, 2014.

* cited by examiner

Section A-A

Section B-B

TURBINE ROTOR FOR A THERMAL ELECTRIC POWER STATION

FIELD OF THE INVENTION

The field of the invention is that of turbine rotors for a thermal electric power station and, more specifically, that of the attachments of blades to a shaft of a rotor.

PRIOR ART

The question of how to attach blades to a shaft of a rotor for a turbine rotor for a thermal electric power station has already seen the emergence of several devices, notably the one for fitting blades to a rotor disk secured to the shaft, the blades having a root in the shape of a "fir tree" and a vane, the blade being fixed to the rotor disk by its root by means of an axially sliding connection with respect to the shaft followed by locking against further axial translational movement.

In this respect, patent application U.S. Pat. No. 4,349,318 is known, this application notably disclosing a rotor of a turbine for a thermal electric power station, said rotor comprising a rotor disk secured to a shaft, said rotor disk comprising a plurality of outgrowths defining channels spaced along its periphery, which channels are directed axially with respect to the rotor disk, and a plurality of blades each comprising a root configured to complement a channel. Such a blade has a degree of mobility in terms of axial translation with respect to said rotor disk. The patent application also describes a locking device for locking the blade in its axial translational movement in a first direction, said locking device being housed mainly in a cavity of the rotor disk, which cavity is situated beneath the root of the blade. An end stop of the blade capable of locking the blade axially in a second direction is also provided, this end stop being formed by a projection able to come into abutment against a surface of the rotor disk and being situated more or less at an axially opposite end of the locking device.

Such a device has the notable disadvantage of exhibiting a high level of stress in the locking device, particularly in the region of the rotor disk secured to the shaft, this stress being caused by the centrifugal pulling of the blade when said rotor shaft is rotating.

Moreover, such stress has the effect of damaging the locking means and potentially of cracking it. As a result, the integrity of the equipment is no longer ensured, and, in the worst case, the blade may become detached.

Another disadvantage with such a device is the complexity involved in manufacturing and using it. Specifically, in order to reduce the high stresses in the region of the locking device, the end stop that locks the blade in one axial direction has been added. Further, the locking device is itself complicated to implement as it too has to be kept fixed by means of another retaining device in the region of an aperture in the cavity of the rotor disk.

SUMMARY OF THE INVENTION

The invention seeks to address all or some of the disadvantages of the prior art, particularly the problems of stress between a shaft secured to a rotor disk and blades of a turbine for a thermal electric power station, the operation of which is dependable and which is easy to implement.

To do so, a first aspect of the invention proposes a rotor of a turbine for a thermal electric power station, said rotor comprising:

a plurality of blades, each comprising at least one root and a vane; and at least one rotor disk secured to a shaft able to be in rotation about a reference axis, the rotor disk comprising on its periphery outgrowths in which to fit the blades, so that the vanes of the blades are arranged radially with respect to the reference axis;

said rotor being one wherein:

the rotor disk comprises a groove opening axially and having a lower face and an upper face, the lower face of the groove of the rotor disk being situated on the periphery of said rotor disk and the upper face of the groove of the rotor disk being situated on the outgrowths and facing the lower face;

each of the blades comprises, at its root, a lateral projection directed axially, said lateral projection having, in its lower part, a groove portion having an upper face situated in the continuation of the upper face of the groove of the rotor disk;

at least one locking means for locking the blades is positioned in the groove of the rotor disk.

Thus, the lateral projection of each of the blades allows the groove of the rotor disk to be offset so that it is not situated directly beneath the root of the blade.

Indeed, such a configuration surprisingly allows a reduction in the stresses due to centrifugal pulling of the blade when said rotor is in operation.

Such a reduction in said stress also gives the blades a longer service life, makes for safer use and opens up the possibility of using blades that are more slender and of greater mass with a load bearing capability that is at least as good.

According to another technical feature, the outgrowths of the rotor disk define channels extending along the reference axis, the roots of the blades each being of the "fir-tree root" type so that each of said roots is in sliding connection with one of said channels.

Such a configuration allows the blades to be fitted by sliding connection into the channels that run axially between the outgrowths. Such fitting is rapid and easy to perform.

Advantageously, the groove of the rotor disk has, in the region of its outgrowths, an axial section that has a cavity and an opening zone via which the groove opens axially, the cavity having a radial width greater than a radial width of the opening zone.

The term "axial section" means a section taken in a plane containing the reference axis.

The term "radial width" likewise means a dimension measured along a straight line orthogonal to the reference axis. A radial width in an axial section, using these definitions, corresponds to a dimension measured along a straight line orthogonal to the reference axis, said straight line and said reference axis being contained in the plane of the section.

Such a configuration makes it possible, on the one hand, for the locking means to be introduced into the cavity thus formed via the opening zone and, on the other hand, for the locking means to be held in the cavity by at least one bearing surface of said cavity when load is applied to the locking means. The bearing surface of the cavity situated near the opening zone then has the function of constraining the locking means inside said cavity, this being permitted notably as a result of the difference in their radial widths.

According to one particular embodiment, the section is substantially T-shaped, oriented axially, i.e. in the shape of a T that has an axis of symmetry defined by a straight line collinear with the reference axis.

In other words, the T-shape is defined by a cavity and an opening zone, the cavity in this section having a substantially oblong shape directed radially with respect to the reference axis, and the opening zone having a straight section directed axially with respect to said reference axis.

According to one particular feature, the rotor disk comprises at least one lateral wall situated on one of the sides of said rotor disk, and the lateral projections of the blade roots each comprise a lateral surface aligned radially with at least one of said lateral walls.

"Lateral" walls mean the walls that extend radially, defining at least one side of their corresponding element.

In particular, such an alignment of the lateral walls in the region of the lateral projection of the blade roots with at least one of the lateral walls of the rotor disk improves the flow of fluid through the turbine and optimizes stress distribution.

Advantageously, the blade locking means have:

at least one lower profile to be fitted into the groove of the rotor disk, in contact with the lower face of said groove of the rotor disk so as more or less to conform to the shape thereof; and at least one upper profile to be fitted into the groove of the rotor disk and into the groove portions of the blades, in contact with the upper faces of said groove of the rotor disk and of said groove portions of said blades so as more or less to conform to the shape thereof.

Such lower and upper profiles therefore allow the blade to be locked, locking it at least in terms of movement in axial translation. Particularly in at least one direction of this reference axis.

Such locking is particularly advantageous, particularly when the blade is fixed in sliding connection with the rotor disk, for example, although not exclusively, by means of its fir-tree root. Specifically, because the blade is in sliding connection it can therefore, by means of these said profiles, be completely locked, which means to say immobilized, when the rotor disk is operating, particularly is rotating.

Advantageously, the lower profile and upper profile comprise at least one intermediate closure piece so as to press at least a lower profile and at least an upper profile respectively firmly against the lower face of the groove and against the upper faces of the groove and of the groove portions.

According to another technical feature:

one of the upper faces of the groove borne by an outgrowth, and an opening situated in the region of one of the channels, said channels each being delimited by two of the outgrowths of the rotor disk extending along the reference axis, together defining a groove spacing for the groove, and the said groove is substantially circular and the lower profile and upper profile form an arc of a circle able to extend over at least one groove spacing of said groove.

Advantageously, the rotor disk has an inside positioned at an air intake of the turbine and an outside positioned at an air outlet from the turbine, the projection being situated on the outside.

What happens is that a thermal electric power station turbine is generally made up of a stator consisting of a casing fitted with fixed deflectors and through which there passes the rotor which comprises a shaft that can be in rotation, the blades being arranged on the rotor disks secured to said shaft. Thus, in the case of a turbine through which a fluid, for example steam, flows, said fluid flows, from where it enters to where it leaves the turbine, from the inside to the outside, the projection advantageously being situated on the outside, i.e. on the side from which the fluid is discharged from the turbine.

Specifically, such a configuration makes it possible to improve the internal aerodynamics of the turbine and thus optimize the flow of fluid.

Another aspect of the invention also proposes a turbine for a thermal electric power station comprising such a rotor.

Yet another aspect of the invention proposes a method for assembling a rotor as described hereinabove, said method involving the following steps:

fitting the blades between the outgrowths;

fitting at least one lower profile and at least one upper profile in the groove of the rotor disk and in the groove portion of the blade;

fitting the intermediate closure piece so as to press at least one lower profile and at least one upper profile respectively firmly against:

the lower face of the groove of the rotor disk; and the upper faces of said groove of the rotor disk and of the groove portions of the blades.

BRIEF DESCRIPTION OF THE DRAWINGS

Other features and advantages of the invention will become apparent from reading the following description, with reference to the attached figures which illustrate.

For greater clarity, elements that are identical or similar are identified by identical reference signs in all of the figures.

DETAILED DESCRIPTION OF ONE EMBODIMENT

Figure 1:
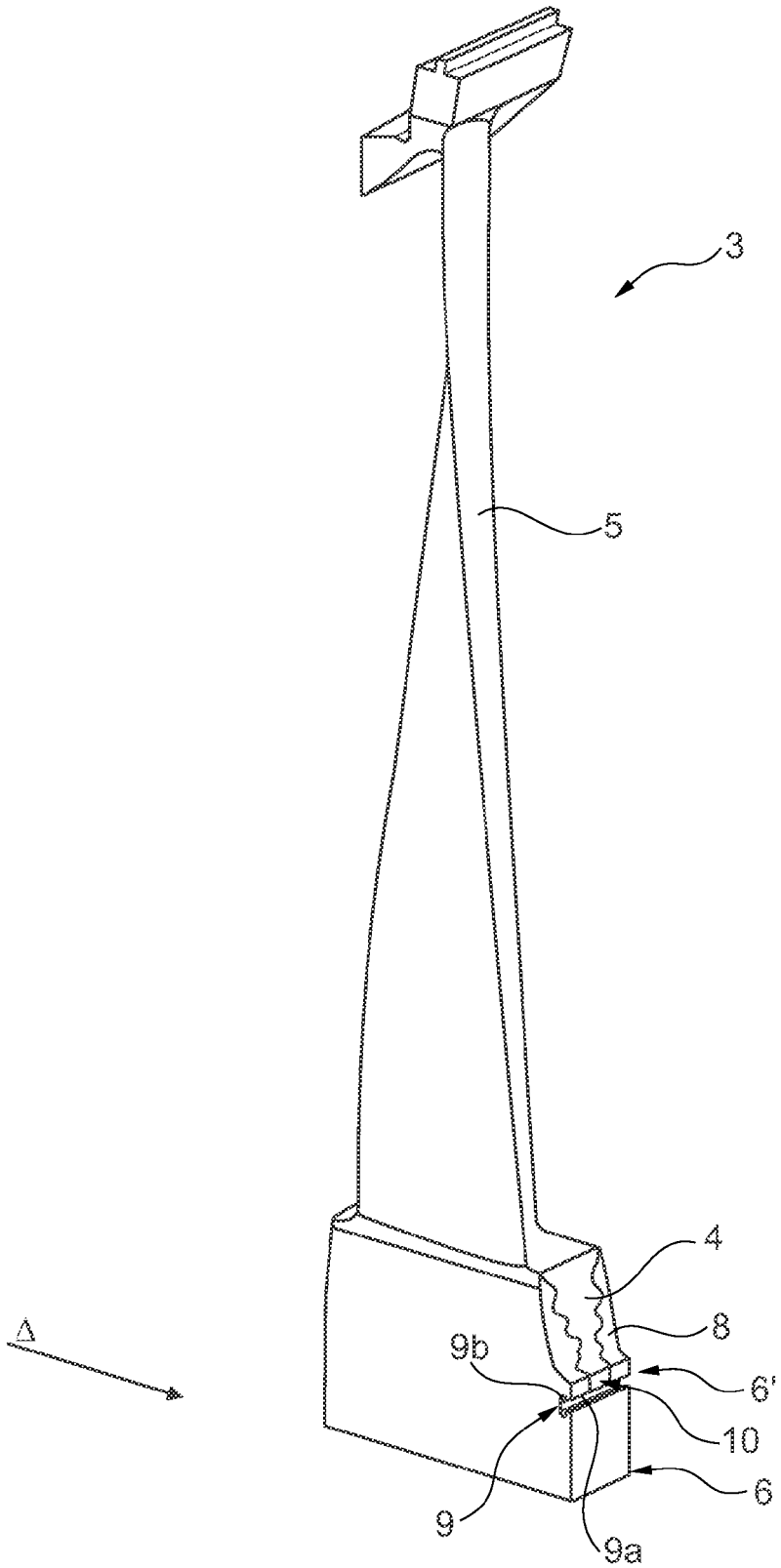
FIG. 1: a diagram of a blade according to one embodiment.

FIG. 1 shows a diagram of a blade according to one embodiment. Specifically, this figure more precisely depicts a blade 3 for a turbine 2 of a thermal electric power station, which blade 3 is arranged on a rotor 1, particularly on a rotor disk 6 of said rotor, which is secured to a shaft 7 able to be in rotation about a reference axis Δ (see also FIG. 10).

For greater clarity, this figure does not depict the rotor disk 6 in its entirety. It merely depicts a peripheral zone 6', situated at the periphery of said rotor disk, comprising outgrowths 8 into which to fit the blade.

In this embodiment, the outgrowths 8 of the rotor disk 6 define channels 14 extending along the reference axis Δ.

Moreover, the roots 4 of the blades 3 are each of the "fir-tree root" type such that each of said roots 4 is in sliding connection with one of said channels 14.

A "fir-tree root" shape is the definition given to a blade root which, in section orthogonal to the reference axis, has an elongate shape having a width measured between its lateral walls which is non-constant, said lateral walls generally being symmetric with respect to one another about a radial axis of symmetry and generally having a wavy profile.

Moreover, the rotor disk 6 comprises a groove 9 opening axially and having a lower face 9*a* and an upper face 9*b*, the lower face 9*a* of the groove 9 of the rotor disk 6 being situated on the periphery 6' of said rotor disk 6 and the upper face 9*b* of the groove 9 of the rotor disk 6 being situated on the outgrowths 8 and facing the lower face 9*a*.

The term "opening axially" means that the groove has an emerging opening directed along the reference axis Δ.

At its root 4, the blade 3 comprises a lateral projection 10 directed axially.

Figure 2:
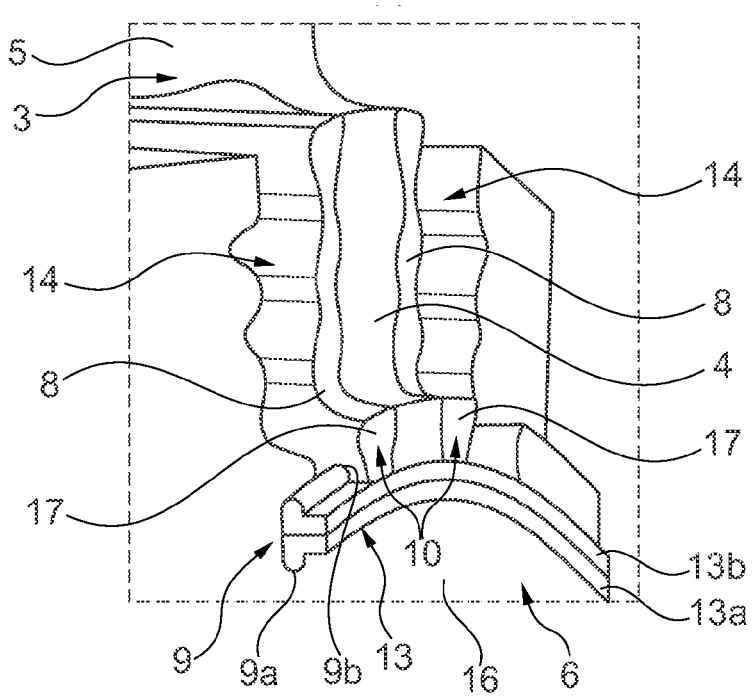
FIGS. 2 and 3: diagrams of a blade arranged on a rotor disk according to one embodiment.
Figure 3:
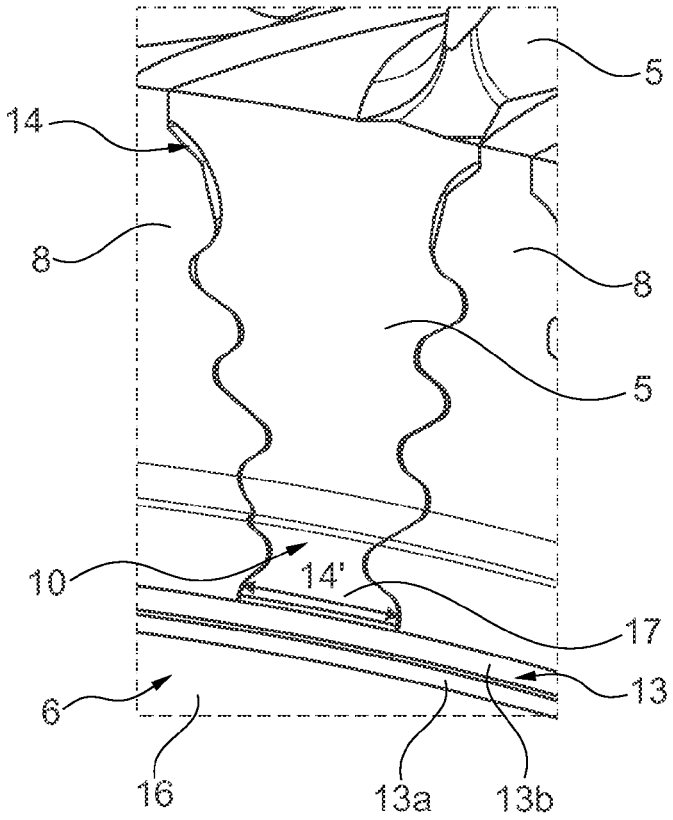

FIGS. 2 and 3 show diagrams of a blade 3 arranged on a rotor disk according to one embodiment. For the sake of clarity, just one blade 3 is depicted here.

In this embodiment, the blade 3 is depicted fixed to the rotor disk 6 via a locking means 13 for locking the blade 3, said locking means 13 being positioned in the groove 9 of the rotor disk 6.

The blade further comprises, at its root 4, a lateral projection 10 directed axially, said lateral projection 10 having, on its lower part 10', a grove portion 11 having an upper face 12 situated, when the blade is positioned in such a channel 14, in the continuation of the upper face 9*b* of the groove 9 of the rotor disk 6.

Thus, the lateral projection 10 of each of the blades 3 allows the groove of the rotor disk to be offset so that it is not situated directly beneath the root of the blade 3. This is because such a configuration makes it possible to reduce the stress caused by the centrifugal pulling of the blade 3 when said rotor is in operation. Such reduction in said stress also allows the blades to be used for a longer period, provides greater operational safety and opens up the possibility of using blades of a greater mass with a load bearing capability that is at least as good.

Doing this is particularly optimal when the projection axially has a length substantially of between 2% and 10% of the axial length of the root 4 of the blade 3.

Advantageously, the axially opening groove 9 has, axially, a depth of between 1% and 7% of said axial length of the root 4 of the blade 3.

More specifically, in order to attach the blade 3 to the rotor disk 6, the blade is fitted by a translational movement of the root 4 of said blade 3 along the axially extending channel 14, said channel 14 being delimited by the outgrowths 8 of the rotor disk 6.

In this embodiment, the blade locking means 13 have:

- a lower profile 13*a*, here arranged in the groove 9 of the rotor disk 6, in contact with the lower face 9*a* of said groove 9 of the rotor disk 6 so as substantially to conform to the shape thereof; and
- an upper profile 13*b*, here arranged in the groove 9 of the rotor disk 6 and in the groove portions 11 of the blades 3, in contact with the upper faces 9*b*, 12*b* of said groove 9 of the rotor disk 6 and of said groove portions 11 of said blades 3 so as substantially to conform to the shape thereof.

Figure 7A:
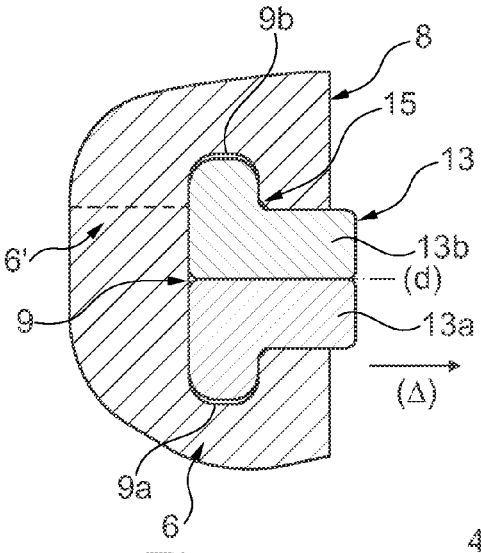
FIGS. 7*a*, 7*b* and 7*c*: diagrams in cross section of the groove comprising the blade locking means according to this same embodiment.
Figure 7B:
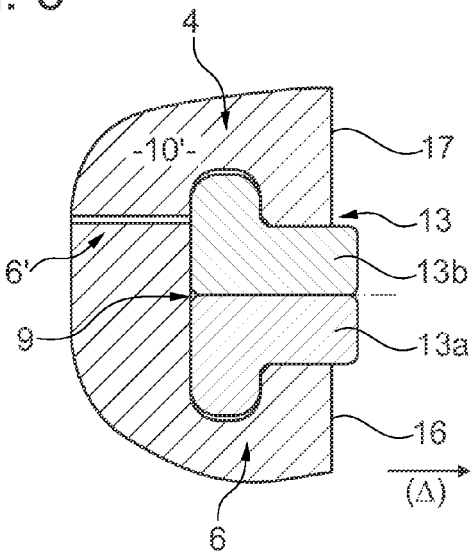
Figure 7C:
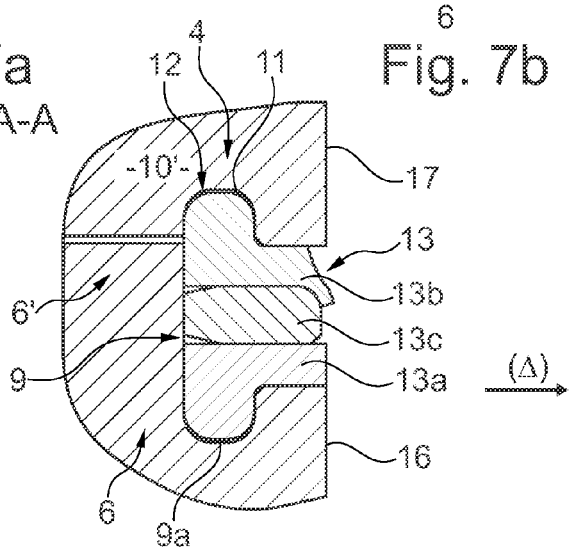

These locking means are described more specifically in FIGS. 7*a*, 7*b* and 7*c*.

Figure 4:
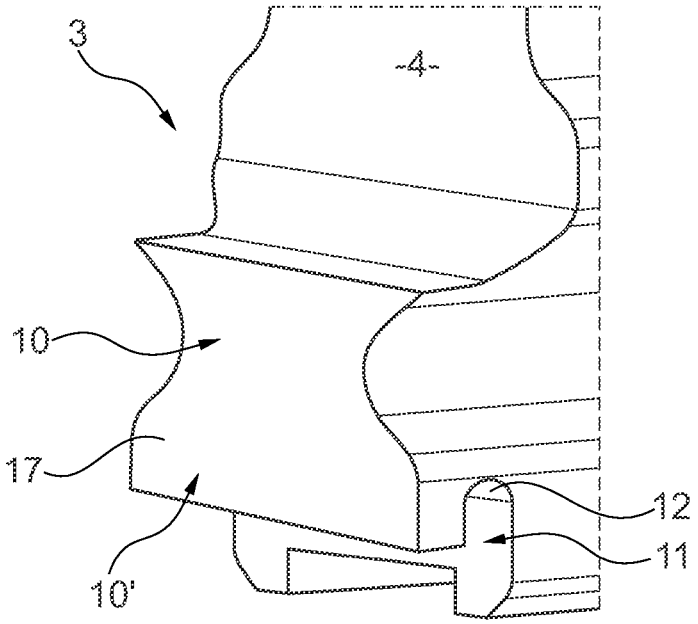
FIGS. 4 and 5: diagrams of a root of a blade according to one embodiment.
Figure 5:
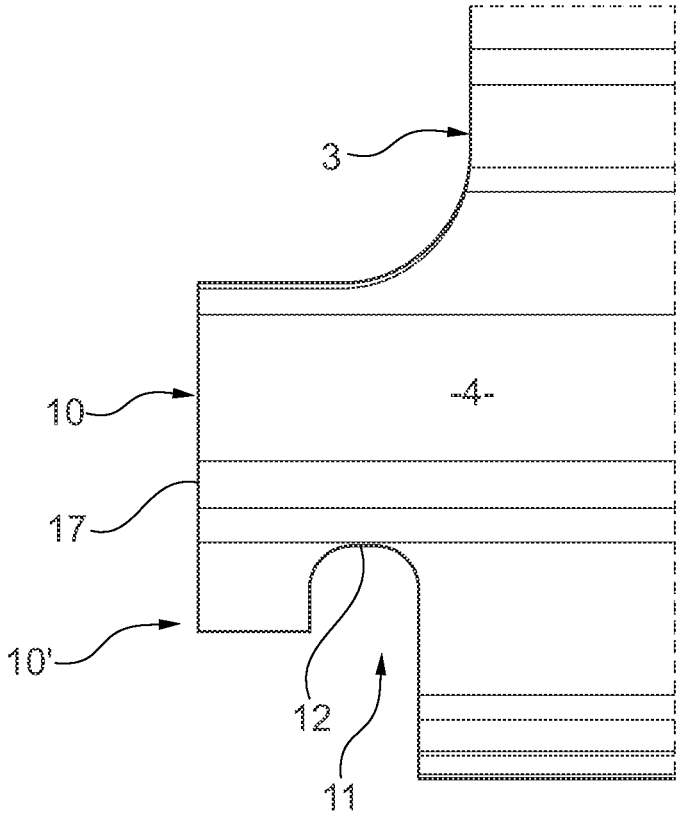

FIGS. 4 and 5 show diagrams of a root 4 of a blade 3 according to one embodiment. Specifically, they more particularly illustrate the lateral projection 10 situated at the root 4 of a blade 3, said lateral projection 10 having, on its lower part 10', a groove portion 11 that has an upper face 12.

When said blade is arranged on a rotor disk 6, said upper face 12 can then be positioned facing the lower face 9*a* and in the continuation of the upper face 9*b* of the groove 9 of the rotor disk 6, said groove 9 opening axially so that the locking means 13 can be housed therein by inserting them through the axially opening opening.

Figure 6:
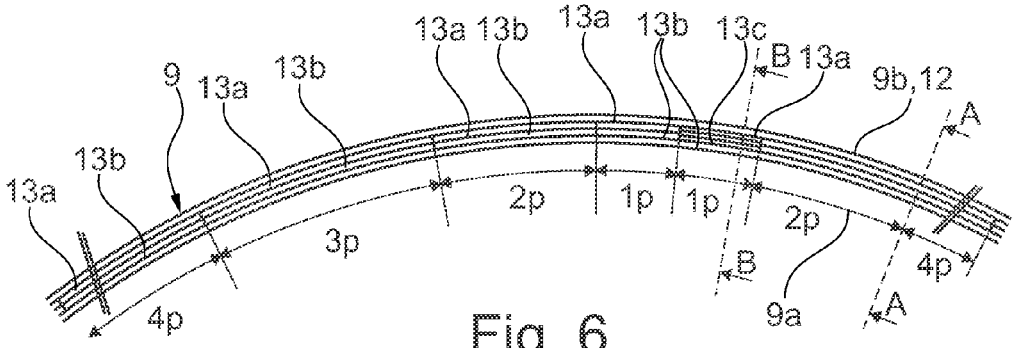
FIG. 6: a diagram of a circular portion of a groove comprising a blade locking means according to one embodiment.

FIG. 6 shows a diagram of a circular portion of a groove 9 comprising the blade locking means 13 according to one embodiment.

Specifically, in this embodiment, the groove 9 is of substantially circular shape. This figure depicts a side view of a portion of an arc of a circle that said groove 9 forms and in which the locking means 13 are inserted.

More specifically, the groove 9 comprises:

- a lower face 9*a* situated on the periphery 6' of said rotor disk 6; and
- an upper face 9*b*, 12 which is, at a given point on the groove 9, either:
  - the upper face 9*b* situated on the outgrowths 8 and facing the lower face 9*a;*
  - or
  - the upper face 12 of the groove portion 11 of the projection 10 of the root 4; the upper faces 9*b* and 12 being arranged in the continuation of one another when the blades are positioned on the rotor disk 6.

These said lower face 9*a* and upper faces 9*b*, 12 are depicted here using discontinuous lines. Because said upper faces 9*b* and 12 are in the continuation of one another, the figure makes no distinction between these two said upper faces 9*b* and 12.

The blades 3 are preferably evenly distributed about the rotor disk 6 as too are the outgrowths 8. It therefore follows that the upper face is delimited continuously, and preferably uniformly, by an alternation either of said upper face 9*b* of the rotor disk 6 or said upper face 12 of the blade 3.

Moreover, the upper face 9*b* of the groove 9 borne by an outgrowth 8, and an opening 14' (see FIG. 3) situated in the region of a channel 14 delimited by two of the outgrowths 8 of the rotor disk 6 extending along the reference axis Δ, define a groove spacing p for the groove 9, the groove 9 being substantially circular and the lower profiles 13*a* and upper profiles 13*b* forming an arc of a circle able to extend over at least one groove spacing p of the substantially circular groove 9.

That means that the blade 3 can be held in place when the locking means are inserted into the groove 9. Specifically, in such a configuration if, for example, an upper profile 13*b* is arranged in the upper groove 12 in contact only with the upper face 9*b* of the rotor disk 6 or the upper face 12 of the root 4 of the blade 3, said blade cannot be locked. To achieve locking, it is necessary for said upper profile to be arranged in contact with at least one of the upper faces 9*b* of the rotor disk 6 and at least one of the upper faces 12 of the roots 4 of the blades 3. That condition is met if the lower profiles 13*a* and upper profiles 13*b* form an arc of a circle extending over at least one groove spacing p as defined.

Various profiles each extending over circular arc portions each equal to a multiple of the groove spacing p, for example over distances equal to one groove spacing 1*p*, two groove spacings 2*p*, three groove spacings 3*p* or even four groove spacings 4*p*, have been depicted for this embodiment.

More specifically, in this embodiment, the blade locking means 13 have:

- a plurality of lower profiles 13*a* to be arranged in the groove 9 of the rotor disk 6, in contact with the lower face 9*a* of said groove 9 of the rotor disk 6 so as substantially to conform to the shape thereof; and a plurality of upper profiles 13*b* to be arranged in the groove 9 of the rotor disk 6 and in the groove portions 11 of the blades 3, in contact with the upper faces 9*b*, 12 of said groove 9 of the rotor disk 6 and of said groove portions 11 of said blades 3 so as substantially to conform to the shape thereof.

Moreover, the lower profiles 13*a* and upper profiles 13*b* here comprise an intermediate closure piece 13*c* extending over one groove spacing p so as to press a lower profile 13*a* and an upper profile 13*b* respectively firmly against the lower face 9*a* of the groove and against the upper faces 9*b*, 12 of the groove 9 and the groove portions 11. In the method of implementation, the intermediate closure piece 13*c* is more or less the last component of the locking means to be fitted.

Specifically, the method for assembling the rotor 1 of the turbine 2 for a thermal electric power station comprises at least the following steps:

fitting the blades 3 between the outgrowths 8;

fitting at least one lower profile 13*a* and at least one upper profile 13*b* in the groove 9 of the rotor disk 6 and in the groove portion 11 of the blade 3;

fitting the intermediate closure piece 13*c* so as to press at least one lower profile 13*a* and at least one upper profile 13*b* respectively firmly against:

the lower face 9*a* of the groove 9 of the rotor disk 6; and the upper faces 9*b*, 12 of said groove 9 of the rotor disk 6 and of the groove portions 11 of the blades 3.

Such an intermediate closure piece 13*c* notably in instances in which the groove is a circular groove, which therefore has no ends such as an arc of a circle, allows the lower profiles 13*a* and upper profiles 13*b* to be inserted alternately therein via the axially opening opening of the groove 9, so that these profiles can be distributed over the entire circularity of the groove, the arrangement of the various profiles then being equivalent to a substantially circular profile.

FIGS. 7*a*, 7*b* and 7*c* show diagrams in cross section of the groove comprising the blade locking means according to this same embodiment.

Specifically, FIG. 7*a* depicts a cross section on A-A. This section is a section in a plane containing the reference axis Δ and taken more or less in the region of an outgrowth 8.

Specifically, the axially opening groove 9 has a lower face 9*a* and an upper face 9*b*, the lower face 9*a* of the groove 9 of the rotor disk 6 being situated on the periphery 6' of said rotor disk 6 and the upper face 9*b* of the groove 9 of the rotor disk 6 being situated on the outgrowths 8 and facing the lower face 9*a*.

Moreover, the groove 9 of the rotor disk 6 has, at its outgrowths 8, a section 15 of substantially T-shape oriented axially, i.e. in the shape of a T having an axis of symmetry defined by a straight line d collinear with the reference axis Δ.

Thus, the T-shaped groove 9 therefore comprises a cavity and an opening zone, the cavity having a section of substantially oblong shape directed radially with respect to the reference axis, and the opening zone having a straight section directed axially with respect to said reference axis Δ.

In addition, the locking means 13 depicted here are a lower profile 13*a* of substantially L-shape which is arranged in the groove 9 of the rotor disk 6 in contact with the lower face 9*a* of said groove 9 of the rotor disk 6 so as substantially to conform to the shape thereof, and an upper profile 13*b* of substantially L-shape which is arranged in the groove 9 of the rotor disk 6 in contact with the upper face 9*b* of said groove 9 of the rotor disk 6 so as substantially to conform to the shape thereof.

These two substantially L-shaped profiles 13*a*, 13*b* form, when arranged in the groove 9, a substantially T-shaped locking means that substantially conforms to the T-shape formed by said groove 9.

Furthermore, FIG. 7*b* differs from FIG. 7*a* essentially in that it depicts a section in a plane containing the reference axis Δ and taken, in this cross section, in the region of a root 4 of a blade 3.

Specifically, the root 4 of the blade comprises a lateral projection 10 directed axially, said lateral projection 10 having, on its lower part 10', a groove portion 11 that has an upper face 12 situated in the continuation of the upper face 9*b* of the groove 9 of the rotor disk 6.

The locking means 13 comprise the same lower profile 13*a* and upper profile 13*b* as those illustrated in FIG. 7*a* except that the upper profile 13*b* here is arranged in a groove portion 11 of one of the blades 3, in contact with the upper face 12 of said groove portion 11 of the blade 3 so as substantially to conform to the shape thereof.

Furthermore, FIG. 7*c* depicts a view in section on B-B. This section is a section in a plane containing the reference axis Δ and taken more or less in the region of a root 4 of a blade 3.

In this view, the locking means further comprises an intermediate closure piece 13*c* so as to press the lower profile 13*a* and the upper profile 13*b* respectively firmly against the lower face 9*a* of the groove and against the upper face 12 of the groove portion 11.

In addition, in this view, the lower profile 13*a* and upper profile 13*b* have smaller dimensions which means that, over a given groove spacing p where said intermediate closure piece 13*c* is to be fitted, this intermediate closure piece can be inserted between said lower 13 and upper 13*b* profiles in such a way as to press them firmly against the surfaces of the groove 9 as explained. Thus, this intermediate closure piece 13*c* allows the locking means to be positioned over the entire circular extent of the groove 9 while at the same time also ensuring, over this entire circular extent of the groove 9, effective locking of the blade in its axial translational movement relative to the rotor disk 6. Any other movement furthermore is prevented by the mechanical connection of sliding connection type between the roots 4 of the blades 3 and the channels 14 by virtue of the "fir-tree root" style of said roots and by virtue of said channels 14 of substantially complementary shape.

Figure 8:
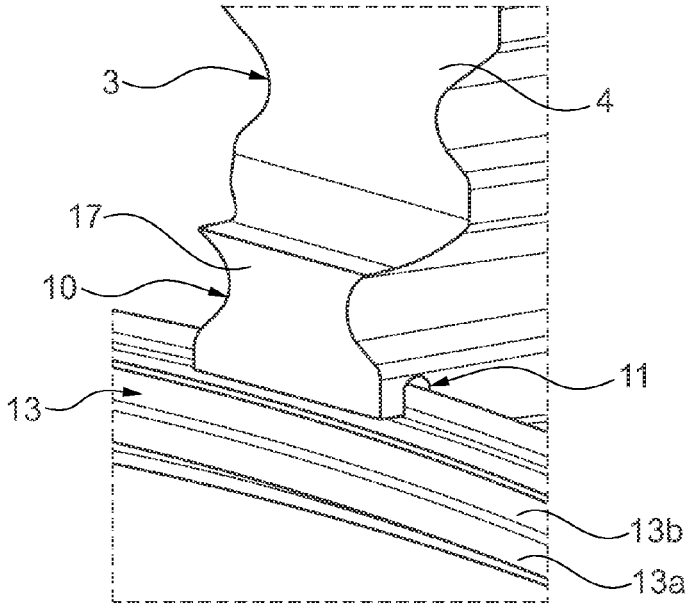
FIG. 8: a diagram of a blade root with a locking means according to one embodiment.

FIG. 8 shows a diagram of a blade root with a locking means according to one embodiment.

The lower profile 13*a* and upper profile 13*b* are depicted in a perspective view here, the upper profile 13*b* being arranged in the groove portion 11 of one of the blades 3 in contact with the upper face 12 of said groove portion 11 of the blade 3 so as substantially to conform to the shape thereof.

Figure 9:
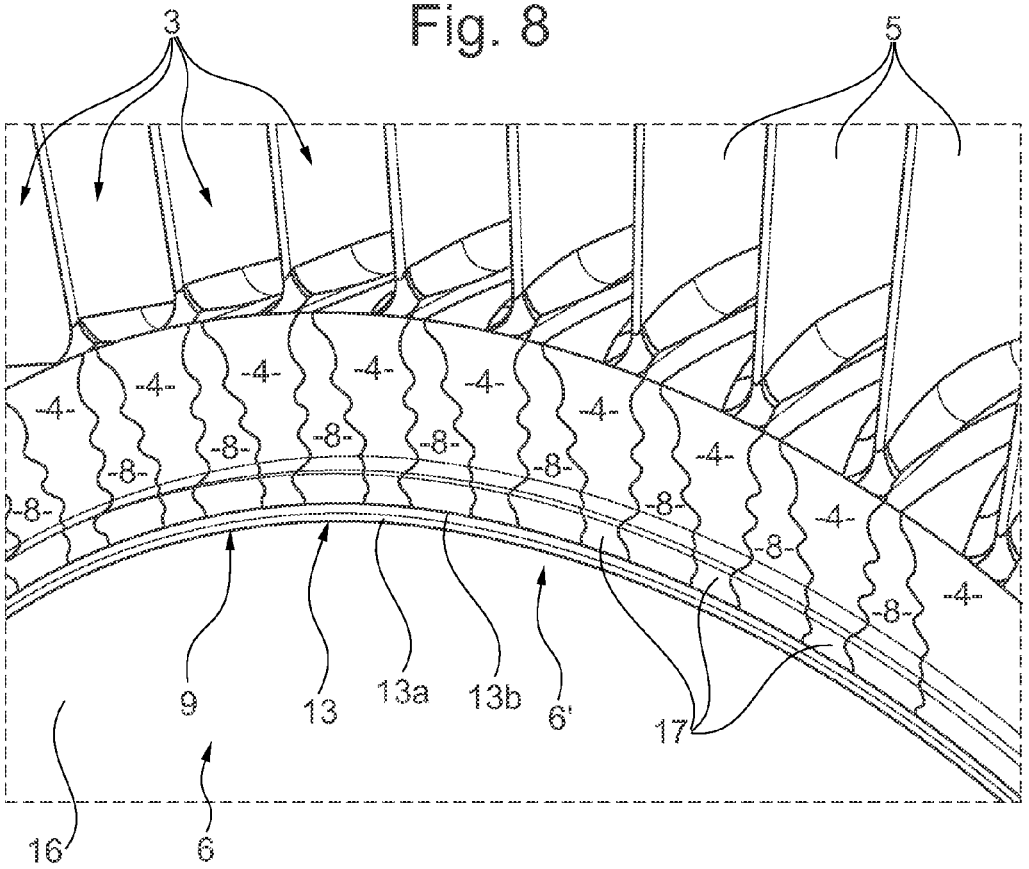
FIG. 9: a diagram of a plurality of blades, each one arranged on a rotor disk according to one embodiment.

FIG. 9 shows a diagram of a plurality of blades 3, each arranged on the rotor disk 6.

Figure 10:
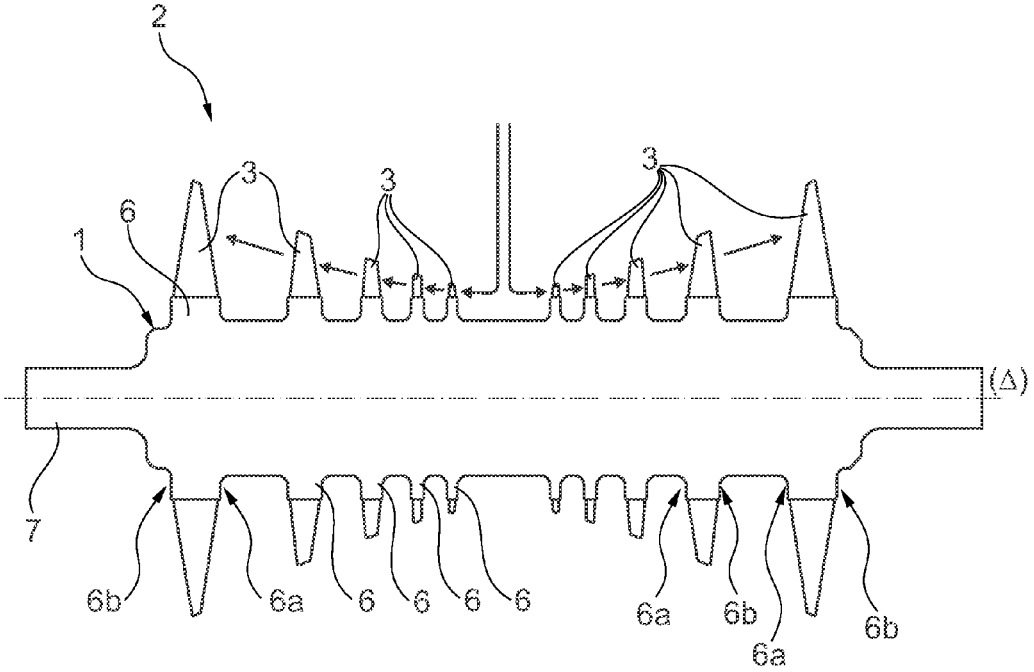
FIG. 10: a turbine rotor according to one embodiment.

FIG. 10 shows a turbine rotor according to one embodiment. Specifically, this figure depicts a simplified diagram of a dual flow low-pressure module, the flow of the steam being indicated in the figure by arrows.

For the sake of clarity, the casing of said turbine 2 has not been illustrated in the figure.

Thus, this figure illustrates a rotor 1 of a turbine 2 for a thermal electric power station, in this instance a nuclear power station, this turbine here being a low-pressure turbine.

In this configuration, the steam is admitted to the turbine more or less in the center thereof and flows through the turbine therefore passing through five "stages", each stage being made up of a rotor disk 6 secured to one and the same shaft 7 that can be in rotation about a reference axis Δ, each of said rotor disks 6 being fitted with a plurality of blades distributed at their periphery. It should be noted that the number of stages is not exhaustive and can vary. Specifically, in the various embodiments, the turbine may, for example, comprise four, five or six stages.

Once it has been admitted to the turbine 2, the steam travels substantially axially, in one direction or the other, passing respectively through a first, a second, a third, a fourth and a fifth stage, driving the rotation of the rotor disks 6 through the action of said steam on the blades 3.

In this embodiment, the fourth and fifth stages, which means to say the last two stages, comprise blades that have roots of the "fir-tree root" type which are also designed to be fixed to the rotor disks in the way described hereinabove. Specifically, such a device is particularly well suited to such a case, the problem surrounding centrifugal force being caused by their weight, the blades being larger, and therefore heavier, in the last (few) stage(s).

By way of example, such a blade designed for such a low-pressure module and arranged on the final stage has a length of 1.80 m and a weight substantially equal to 83 kg.

That being so, and according to the prior art, the centrifugal force is around 400 metric tons at a rotational speed of 1500 revolutions per minute.

Implementing the invention therefore makes it possible to reduce such stresses on the roots of the blades.

Moreover, in this embodiment, the rotor disks 6 each have an inside 6*a* arranged at an air intake to the turbine 2 and an outside 6*b* arranged at an air outlet from the turbine 2, the lateral projection 10 of each of the roots 4 of the blades 3 being situated on the outside 6*b*.

The invention has been described in the foregoing by way of example. Quite obviously a person skilled in the art can create various alternative embodiments of the invention without thereby departing from the scope of the invention.

We claim:

1. A rotor of a turbine for a thermal electric power station, said rotor comprising:

a plurality of blades, each blade comprising at least one root and a vane; and at least one rotor disk secured to a shaft operable for rotation about a reference axis, the rotor disk comprising on a periphery of the rotor disk outgrowths in which to fit the blades, so that the vanes of the blades are arranged radially with respect to the reference axis;

said rotor being one wherein:

the rotor disk comprises a groove with an axial opening and having a groove lower face and a groove upper face, the groove lower face arranged on the periphery of said rotor disk and the groove upper face arranged on the outgrowths of the rotor disk opposite the groove lower face;

each of the blades comprises, from the root of the blade, a lateral projection directed axially beyond the vane of the blade, said lateral projection comprising a lower part and a groove portion having a blade upper face for continuation of the groove upper face when the blades are arranged within the outgrowths of the rotor disk, wherein said lateral projection offsets the groove portion such that the groove portion is not placed beneath the root of the blade; and at least one lock positioned through the axial opening in the groove of the rotor disk for locking the blades within the outgrowths of the rotor disk.

2. The rotor as claimed in claim 1, wherein the rotor disk has an inside positioned at an air intake of the turbine and an outside positioned at an air outlet from the turbine, the lateral projection arranged on the outside.

3. The rotor as claimed in claim 1, wherein the groove of the rotor disk defines a cavity and an opening zone, with the opening zone at the axial opening, and the cavity having a radial width greater than a radial width of the opening zone.

4. The rotor as claimed in claim 3, wherein the at least one lock comprises:

at least one lower profile sized to fit into the groove of the rotor disk, in contact with the groove lower face; and at least one upper profile sized to fit into the groove of the rotor disk in contact with the groove upper faces and into the groove portions of the blades, in contact with the blade upper faces.

5. The rotor as claimed in claim 1, wherein the at least one lock comprises:

at least one lower profile for fit in the groove of the rotor disk, in contact with the groove lower face; and at least one upper profile for fit in the groove of the rotor disk and into the groove portions of the blades, in contact with the groove upper faces of said groove of the rotor disk and in contact with the blade upper faces of said groove portions of said blades, respectively.

6. The rotor as claimed in claim 5, wherein the at least one lower profile and the at least one upper profile comprise at least one intermediate closure piece, for pressure of the at least one intermediate closure piece on the at least one lower profile against the groove lower face, and the at least one upper profile against the groove upper faces of the groove and the blade upper faces of the groove portions.

7. A method for assembling a rotor of a turbine for a thermal electric power station, as claimed in claim 6, said method comprising:

fitting the blades between the outgrowths;

fitting through the axial opening the at least one lower profile and the at least one upper profile in the groove of the rotor disk and in the groove portion of the blade; and fitting through the axial opening the intermediate closure piece for pressure on the at least one lower profile against the groove lower face and the at least one upper profile against the groove upper faces and against the blade upper faces.

8. The rotor as claimed in claim 6, further comprising:

one of the groove upper faces borne by an outgrowth; and an opening of one of the channels with each channels delimited by two of the outgrowths of the rotor disk extending along the reference axis;

together the one of the groove upper faces and the opening defining at least one groove spacing for the groove, and wherein said groove spacing is substantially circular and the lower profile and the upper profile form an arc of a circle extending over at least one groove spacing of said groove, wherein the lower profile and the upper profile comprise at least one intermediate closure piece for pressure on the lower profile against the groove lower face and the upper profile against the upper faces and blade upper faces.

9. The rotor as claimed in claim 1, wherein the outgrowths of the rotor disk define channels extending along the reference axis, each channel shaped to correspond with and be receptive of the roots of the blades for sliding connection of the root within the channels.

10. The rotor as claimed in claim 9, wherein the groove defines a cavity, an opening zone, and the axial opening via which the groove opens axially, the cavity having a radial width greater than a radial width of the opening zone.

11. The rotor as claimed in claim 9, wherein the at least one lock comprises:

at least one lower profile sized for fit into the groove of the rotor disk, in contact with the groove lower face; and at least one upper profile sized for fit into the groove of the rotor disk in contact with the groove upper faces, and into the groove portions of the blades in contact with the blade upper faces.

12. The rotor as claimed in claim 9, further comprising:

one of the groove upper faces borne by an outgrowth;

an opening of one of the channels delimited by two of the outgrowths of the rotor disk extending along the reference axis; and the one of the groove upper faces and the opening together define at least one groove spacing for the groove;

wherein said groove spacing is substantially circular with at least one lower profile and at least one upper profile of the at least one lock together forming an arc of a circle extending over at least one groove spacing of said groove; and wherein:

the at least one lower profile of the at least one lock is fitted into the groove of the rotor disk in contact with the groove lower face; and the at least one upper profile of the at least one lock is fitted into the groove of the rotor disk in contact with the groove upper face and fitted into the groove portions of the blades in contact with the blade upper faces.

13. A method for assembling a rotor of a turbine for a thermal electric power station, as claimed in claim 12, said method comprising:

fitting the blades between the outgrowths;

fitting through the axial opening the at least one lower profile and the at least one upper profile in the groove space of the groove of the rotor disk and in the groove portion of the blades; and fitting through the axial opening the intermediate closure piece for pressure on the at least one lower profile against the groove lower face and for pressure on the at least one upper profile against the groove upper faces and blade upper faces.

* * * * *